US008584966B2

(12) United States Patent
Roche et al.

(10) Patent No.: US 8,584,966 B2
(45) Date of Patent: Nov. 19, 2013

(54) EXTENSIBLE STRAW FOR A DISPOSABLE COLLAPSIBLE DRINK MIXING CONTAINER

(76) Inventors: Sharla D. Roche, Sapulpa, OK (US); Gary V. VanMeter, Tecumseh, OK (US)

( * ) Notice: Subject to any disclaimer, the term of this patent is extended or adjusted under 35 U.S.C. 154(b) by 220 days.

(21) Appl. No.: 13/134,257

(22) Filed: Jun. 2, 2011

(65) Prior Publication Data

US 2011/0233297 A1 Sep. 29, 2011

Related U.S. Application Data

(63) Continuation of application No. 12/268,219, filed on Nov. 10, 2008, now abandoned, which is a continuation-in-part of application No. 11/900,060, filed on Sep. 10, 2007, now Pat. No. 7,823,802, which is a continuation-in-part of application No. 11/397,219, filed on Apr. 4, 2006, now abandoned.

(51) Int. Cl.

| | |
|---|---|
| ***A47G 21/18*** | (2006.01) |
| ***A61J 15/00*** | (2006.01) |
| ***B05B 12/14*** | (2006.01) |
| ***E03B 9/20*** | (2006.01) |

(52) U.S. Cl.
USPC ..... 239/33; 239/24; 30/141; 426/85

(58) Field of Classification Search
USPC ..... 239/16–33; 220/705–709
See application file for complete search history.

(56) References Cited

U.S. PATENT DOCUMENTS

| | | | | |
|---|---|---|---|---|
| 2,128,448 | A | | 8/1938 | Wright |
| 2,288,848 | A | * | 7/1942 | Schuessler ..... 239/33 |
| 2,392,479 | A | * | 1/1946 | Humbert ..... 229/103.1 |
| 2,724,536 | A | | 11/1955 | Pugh, Sr. |
| 2,997,195 | A | | 8/1961 | Yuen |
| 3,143,429 | A | | 8/1964 | Swanson |
| 3,173,566 | A | * | 3/1965 | Talbert ..... 215/229 |
| 3,434,589 | A | | 3/1969 | Valtri et al. |
| 3,542,190 | A | | 11/1970 | Keller |
| 3,542,566 | A | * | 11/1970 | Wakefield ..... 206/216 |
| 4,688,721 | A | * | 8/1987 | Inaba ..... 239/33 |
| 4,736,887 | A | * | 4/1988 | Inaba ..... 239/33 |
| 4,850,533 | A | * | 7/1989 | Hoshi et al. ..... 239/33 |
| 4,911,315 | A | * | 3/1990 | Shrum ..... 215/229 |
| 5,029,719 | A | | 7/1991 | Solomon |
| 5,039,012 | A | * | 8/1991 | Inaba ..... 239/33 |
| D327,848 | S | | 7/1992 | Hanover |
| 5,156,335 | A | * | 10/1992 | Smith et al. ..... 239/33 |
| 5,221,016 | A | | 6/1993 | Karpal |
| 5,384,138 | A | | 1/1995 | Robbins |

(Continued)

FOREIGN PATENT DOCUMENTS

GB 2198622 A 6/1988

OTHER PUBLICATIONS

International Preliminary Report on Patentability (PCT/US07/08486); issued Nov. 13, 2008 by the International Bureau of WIPO; 5 pages.

*Primary Examiner* — Len Tran
*Assistant Examiner* — Alexander M Valvis
(74) *Attorney, Agent, or Firm* — Gable Gotwals

(57) ABSTRACT

An extensible straw for incorporation as an integral component of a disposable or collapsible beverage container has telescoping tubes extensible from the container, a screw cap and multiple seals preventing inadvertent leakage from the container whether the container is maintained upright or not.

13 Claims, 12 Drawing Sheets

(56) References Cited

U.S. PATENT DOCUMENTS

| | | | | | |
|---|---|---|---|---|---|
| 5,450,972 | A | | 9/1995 | Zemlo | |
| 5,460,287 | A | | 10/1995 | Cargile et al. | |
| 5,609,899 | A | | 3/1997 | Spector | |
| 5,718,681 | A | * | 2/1998 | Manning | 604/518 |
| 5,727,734 | A | * | 3/1998 | Su | 239/33 |
| 5,731,021 | A | | 3/1998 | Spector | |
| 5,820,023 | A | | 10/1998 | Kristensson | |
| 5,823,383 | A | | 10/1998 | Hins | |
| 5,823,422 | A | * | 10/1998 | Collier et al. | 229/103.1 |
| 5,901,882 | A | * | 5/1999 | Siegel | 222/131 |
| 5,937,617 | A | | 8/1999 | Yeager | |
| 6,076,967 | A | | 6/2000 | Beaudette | |
| 6,102,227 | A | | 8/2000 | Cochrane | |
| 6,102,568 | A | | 8/2000 | Davis | |
| 6,158,611 | A | * | 12/2000 | Cornell et al. | 220/706 |
| 6,234,342 | B1 | | 5/2001 | Cornell et al. | |
| 6,293,394 | B1 | | 9/2001 | Marbler | |
| D449,092 | S | * | 10/2001 | Brog et al. | D23/209 |
| 6,298,885 | B1 | | 10/2001 | Yoshino | |
| 6,427,928 | B1 | | 8/2002 | Hirota | |
| 6,460,776 | B1 | * | 10/2002 | Float et al. | 239/33 |
| 6,482,451 | B1 | * | 11/2002 | Baron | 426/85 |
| 6,685,103 | B2 | * | 2/2004 | Hosi et al. | 239/33 |
| 6,935,492 | B1 | | 8/2005 | Loeb | |
| 7,823,802 | B1 | * | 11/2010 | Roche et al. | 239/33 |
| 2001/0002024 | A1 | | 5/2001 | Edwards | |
| 2003/0221393 | A1 | | 12/2003 | Kothari | |
| 2005/0061822 | A1 | * | 3/2005 | Naesje | 220/705 |
| 2005/0147329 | A1 | | 7/2005 | Arvizu | |
| 2005/0173554 | A1 | * | 8/2005 | Kuwagaki et al. | 239/24 |
| 2006/0027675 | A1 | | 2/2006 | Takeda | |

* cited by examiner

EXTENSIBLE STRAW FOR A DISPOSABLE COLLAPSIBLE DRINK MIXING CONTAINER

REFERENCE TO PENDING APPLICATIONS

This application is a continuation application claiming priority to U.S. patent application Ser. No. 12/268,219, filed Nov. 10, 2008, entitled Extensible Straw for a Disposable Collapsible Drink Mixing Container, which is a continuation-in-part application claiming priority to U.S. patent application Ser. No. 11/900,060, filed Sep. 10, 2007, entitled Extensible Straw for a Disposable Collapsible Drink Mixing Container, now U.S. Pat. No. 7,823,802, issued Nov. 2, 2010, which is a continuation-in-part application claiming priority to U.S. patent application Ser. No. 11/397,219, filed Apr. 4, 2006, entitled Disposable Collapsible Drink Mixing Container.

REFERENCE TO MICROFICHE APPENDIX

This application is not referenced in any microfiche appendix.

BACKGROUND OF THE INVENTION

This invention relates generally to containers for beverages and more particularly concerns disposable containers for storing and mixing drink ingredients with water or other liquids and the straws used for dispensing the mixed beverage from the container to the consumer.

There are a variety of known disposable containers for carrying beverages in liquid form for consumption directly from the container. Some use straws, stored either inside or outside the container. There are also collapsible containers for carrying ingredients in a solid or concentrated liquid to be mixed with water or other liquids at the time of consumption. There are several problems and inconveniences inherent in the configuration of these known disposable and collapsible containers.

The disposable containers store the beverage in a liquid, ready-to-drink state. Consequently, the container takes on the full weight and volume of the ready-to-drink beverage whether or not the consumer is ready to drink. This weight and volume may not pose a significant disadvantage if only one container is being transported but, for example, to a hiker or soldier on an extended trip with no source of flavored or fortified drinks along the way, the weight and volume of multiple containers becomes a burden. Furthermore, known disposable containers generally cannot be resealed and have no suitable access for adding liquid.

Those disposable containers which require straws do not have straw-to-container accesses which satisfactorily minimize leakage during use. Those which do not require straws have drink dispensing ports which are not satisfactory in terms of spillage of beverage during drinking or which would make satisfactory collapse of the container difficult if not impossible.

The collapsible containers for drink ingredients are generally intended for repeated use and are not intended to be disposable after a single use. While they are collapsible to some extent, they do not collapse sufficiently to make it feasible to carry many of them at the same time. Since they are reusable, they are generally made of too expensive and heavy materials and of too complex structural configuration for one-time-only use.

The straws commonly in use for extracting beverages from collapsible and disposable beverage containers are supplied external to the container and are easily lost. They are inserted into the container by puncturing a hole through the container wall at a specific location near or at the top of the container, and therefore, require a sharp point on one end, an undesirable feature especially for children. The containers are difficult to transport without leakage if the beverage in the container is only partially consumed, generally requiring that the collapsible beverage container stay in an upright position and not be compressed. This problem is all the more compelling if the container is used by a very active person such as a biker, hiker or soldier.

Known telescoping straws do not provide for sealing the bottom end of the straw to prevent the entrance of liquid when the fully- or partially-filled beverage container is transported with the straw in place. Known telescoping straws do not provide adequate seals against flow of liquid between the inner and outer tubular straw members.

Caps are not supplied with the straws commonly used with collapsible and disposable beverage containers and, when they are supplied they do not adequately seal the container for transport with the straw in place.

It is, therefore, an object of this invention to provide a disposable beverage ingredients container which collapses to a substantially flat condition. Another object of this invention is to provide a disposable beverage ingredients container which stores beverage ingredients in a solid or condensed liquid state. Still another object of this invention is to provide a disposable beverage ingredients container into which the consumer can add water or other liquids at the time of consumption. It is also an object of this invention to provide a disposable beverage ingredients container in which stored ingredients can be mixed with water or other liquids at the time of consumption. A further object of this invention is to provide a disposable beverage ingredients container from which the consumer can drink directly without a straw. Yet another object of this invention is to provide a disposable beverage ingredients container which includes a straw. Another object of this invention is to provide a disposable beverage ingredients container which has a leakage resistant straw-to-container access. Still another object of this invention is to provide a disposable beverage ingredients container which has a spillage resistant filling port. It is also an object of this invention to provide a disposable beverage ingredients container which has a filling port which can be resealed. A further object of this invention is to provide a disposable beverage ingredients container with a straw that can be closed. Yet another object of this invention is to provide a disposable beverage ingredients container which is simply and inexpensively constructed. And it is an object of this invention to provide a disposable beverage ingredients container which may be resealable for future use.

Another object of this invention is to provide a straw which can be incorporated as an integral part of a collapsible or disposable beverage container. Still another object of this invention is to provide a straw which does not require a sharp point on one end. It is also an object of this invention to provide a straw that establishes a seal between the straw and the beverage container wall. A further object of this invention is to provide a telescoping straw which seals against liquid entrance or exit on both ends of the straw when it is in a collapsed condition. Yet another object of this invention is to provide a telescoping straw which effectively seals against flow of liquid between the inner and outer tubular straw members. Another object of this invention is to provide a telescoping straw which cannot be extended beyond a predetermined limit. Still another object of this invention is to provide a telescoping straw equipped with a cap which fully encloses the top of the straw. And it is an object of this invention to provide a telescoping straw equipped with a cap provides multiple seals to prevent the escape of liquid.

SUMMARY OF THE INVENTION

In accordance with the invention, a drink has a liquid-tight*film pouch which is collapsible into a substantially flat condition. Drink ingredients in a solid or condensed liquid state can be stored in or added to the pouch through an opening in an upper portion of the pouch. A cover with a liquid tight seal closes the opening. The opening is located and the cover contoured to conform with the desired substantially flat storage condition.

Preferably, the pouch has opposed front and rear panels sealed together along their side edges and top and bottom panels with their perimeters sealed to the top and bottom perimeters of the front and rear panels. The top and bottom panels are foldable across their widths into the substantially flat condition and are preferably elliptical so the pouch assumes a substantially ovate horizontal cross-section condition as it is filled with liquid. In preferred embodiments, the fill opening may be approximately centered on and have a perimeter on one side of the major axis of the elliptical top panel or may be spaced away from the minor axis with its perimeter on one side of the major axis of the elliptical top panel.

The fill opening has a resealable cover which may be a plug insertable into the opening. In one embodiment, the plug and the opening have co-operable means on peripheral edges thereof for resisting inadvertent removal of the plug from the opening. For example, the cover may have a flat, thin, substantially rigid collar fixed around a perimeter of the opening and be hinged to a flat, thin, substantially rigid plug insertable into the collar. Alternatively, the fill opening can be covered with an adhesive strip. The pouch may also have a dispense opening in its top panel, preferably with its perimeter on one side of the major axis of the top panel. The dispense opening may have a straw extending through it. Preferably, the straw has a first tubular member with a closed bottom end and at least one aperture through a lower portion of its side wall and a second tubular member longer than and in reciprocally slidable abutment within the first tubular member. The second tubular member slides between a closed condition with an open bottom end of the second tubular member seated on the closed bottom end of the first tubular member and an open condition with the open bottom end of the second tubular member above an uppermost of the second tubular member apertures. Preferably, the tubular members have means on their abutting surfaces for sealing the annulus between them against flow of liquid into the bottom of the second tubular member when the bottom of the second tubular member is seated on the bottom of the first tubular member. The sealing means may, for example, be a mating annular ring and groove on the tubular members in the annulus below the lowermost aperture of the first tubular member or a conical protrusion in the bottom of the first tubular member for seating the open bottom of the second tubular in the closed condition. The straw may also include means on abutting surfaces of the tubular members for sealing the annulus against upward flow of liquid to a top of the first tubular member. This may also be accomplished by one or more sets of mating annular rings and grooves.

A cap may be used to close the open upper end of the second tubular member against upward flow of liquid. If so, it is preferred that the cap is attached to the pouch by a flexible connector so that the cap can be mounted on and removed from the upper end of the second tubular member. Means is also provided for locking the tubular members in the closed condition, such as mating male and female threads on abutting surfaces of the tubular members.

Whether the container has separate fill and dispense openings, has a common fill and dispense opening, or uses or does not use a straw, it will store the mixing ingredients in substantially flat packages which are easily stacked on each other for transport.

A preferred embodiment of the straw has an outer tubular member and an inner tubular member longer than the outer tubular member. The outer tubular member has a closed bottom end and at least two apertures through the lower portion of its side wall. The inner tubular member has an upper portion of outer diameter which is reciprocally slidable in abutment within the upper portion of the outer tubular member. The inner tubular member slides between a fully-closed condition when its open bottom end is seated on the closed bottom end of the outer tubular member and a fully-opened condition when its open bottom end is above an uppermost of the apertures in the outer tubular member. Preferably, the closed bottom end of the outer tubular member has a dome-like protrusion extending upwardly for at least partial insertion into the open bottom end of the inner tubular member so that the protrusion and the open bottom end can mate to provide a seal against flow of liquid into the open bottom end in the fully-closed condition.

It is further preferred that the annulus between the tubular members be sealed against flow of liquid when the bottom of the inner tubular member is seated on the bottom of the outer tubular member. Abutting surfaces of the tubular members are configured for this purpose by inclusion of a pair of co-operable tapered surfaces, one on the inner wall of the outer tubular member and another on the outer wall of the inner tubular member. The pair mates not lower than above the uppermost of the apertures of the outer tubular member so as to prevent flow in the annulus above the mating point. The tapers are also dimensioned to provide a concentric space in the annulus below their mating point so that liquid flows through the apertures into the inner tubular member as soon as the inner tubular member has been withdrawn from the fully closed condition. The annulus between the inner and outer walls of the tubular members may further be sealed against flow of liquid when the bottom of the inner tubular member is not fully closed. An annular bead on either the outer wall of the inner tubular member or the inner wall of the outer tubular member above the tapered surface seal will serve this purpose.

A top end seal may be formed by inclusion of another pair of tapered surfaces, one on the inner wall of the outer tubular member and another on the outer wall of the inner tubular member. This top end pair of tapered surfaces mates proximate the upper end of the outer tubular member and helps assure that liquid will not inadvertently leak from the straw outside of the container.

To prevent complete withdrawal of the inner tubular member from the outer tubular member, an annular groove in the inner wall of the outer tubular member co-operates with a ring of flexible radial tabs which extend inwardly from the circumferential wall of the annular groove and into flapping contact with the outer wall of the inner tubular member during reciprocal motion of the inner tubular member. An annular slot in the outer wall of the inner tubular member receives the tabs when the annular slot and the annular groove are aligned. The tabs have upper surfaces which, when forces on the tabs are released in the slot, abut the upper surface of the annular groove. This prohibits disengagement of the tabs from the annular slot. Thus, the elevations of the tabs and slot on their respective tubes set the predetermined limit beyond which the inner tubular member cannot be withdrawn.

The open top of the inner tubular member is preferably covered and uncovered by use of a cap. In a preferred embodiment of the cap, a plug in the top of the cap inserts into the open top end of the inner tubular member. Complementary threads on the inside of the cap sidewalls and the outside of the outer tubular member draw the cap plug and the closed bottom end of the outer tubular member toward each other cap is tightened on the threads. This simultaneously seals the open top and bottom ends of the inner tubular member in the fully-closed condition. An annular flange may be provided around the outer tubular member and positioned to lie below the cap in the fully-closed condition. A tether connects the cap to the annular flange.

In conjunction with the cap, the straw may also have another pair of top end tapered surfaces co-operable with the first top end tapered surfaces. The added pair has one tapered surface on the outer wall of the outer tubular member and the other tapered surface on the inner wall of the cap. This pair of tapered surfaces also mates at the upper end of the outer tubular member so that the upper end of the outer tubular member is squeezed between these pairs of tapers in the fully-closed condition to tightly seal the straw assembly.

In yet another embodiment, the straw has a body with a passage extending longitudinally through it from top to bottom. An outer tubular member depends from the body. The bottom end of the outer tubular member is closed and the side wall of the outer tubular member has at least one longitudinal slot, and preferably two diametrically opposed longitudinal slots, extending upwardly from its bottom end. An inner tubular member extends through the body and into the outer tubular member. The diameter of the inner tubular member is such as to be engaged in and snugly reciprocally slide in the body passage. The diameters of the inner and outer tubular members are such as to create an annular passage between them. The inner tubular member reciprocates between a fully-closed condition in which the open bottom end of the inner tubular member is seated on the closed bottom end of the outer tubular member and a fully-opened condition in which the open bottom end of the inner tubular member is raised above the closed bottom end of the outer tubular member. Preferably, the closed bottom end of the outer tubular member has an upwardly extending dome-like protrusion which at least partially inserts into and mates with the open bottom end of the inner tubular member to provide a seal against flow of liquid into the open bottom end in the fully-closed condition. Also preferably, an outward flare on the open bottom end of the inner tubular member cooperates with the dome-like protrusion to provide the seal. During withdrawal of the inner tubular member from the outer tubular member, the flare will eventually mate with a tapered surface on an inner wall of the body to prevent further withdrawal of the inner tubular member from the body.

A cap with a top and sidewalls covers the open top end of the inner tubular member. Complementary threads on the inside of the cap sidewalls and the outside of the body draw the cap and the closed bottom end of the outer tubular member toward each other during tightening rotation of the threads. A plug in the top of the cap is inserted into the open top end of the inner tubular member as the straw comes into the fully closed condition. Thus the cap plug and outer tubular member closed bottom simultaneously seal the open top and bottom ends of the inner tubular member when the straw is in the fully-closed condition. Complementary tapers on the outside wall of the body above the threads and on the inside wall of the cap above the threads are also drawn into abutment with each other to provide a seal between the cap and the body when the straw is in the fully-closed condition. Preferably, to provide tamper-evident protection, an annular flange is provided on the body below the threads and the cap has a breakaway portion on its bottom end engaged on the flange so that the breakaway portion is separated from the cap the first time the cap is unscrewed from the body. A tether connects the cap to the breakaway portion.

The outer surface of the body is adapted for liquid-tight connection to a liquid container with the outer tubular member inside the container and the upper portion of the body outside of the container.

BRIEF DESCRIPTION OF THE DRAWINGS

Other objects and advantages of the invention will become apparent upon reading the following detailed description and upon reference to the drawings in which.

While the invention will be described in connection with preferred embodiments thereof, it will be understood that it is not intended to limit the invention to those embodiments or to the details of the construction or arrangement of parts illustrated in the accompanying drawings.

DETAILED DESCRIPTION

Figure 1:
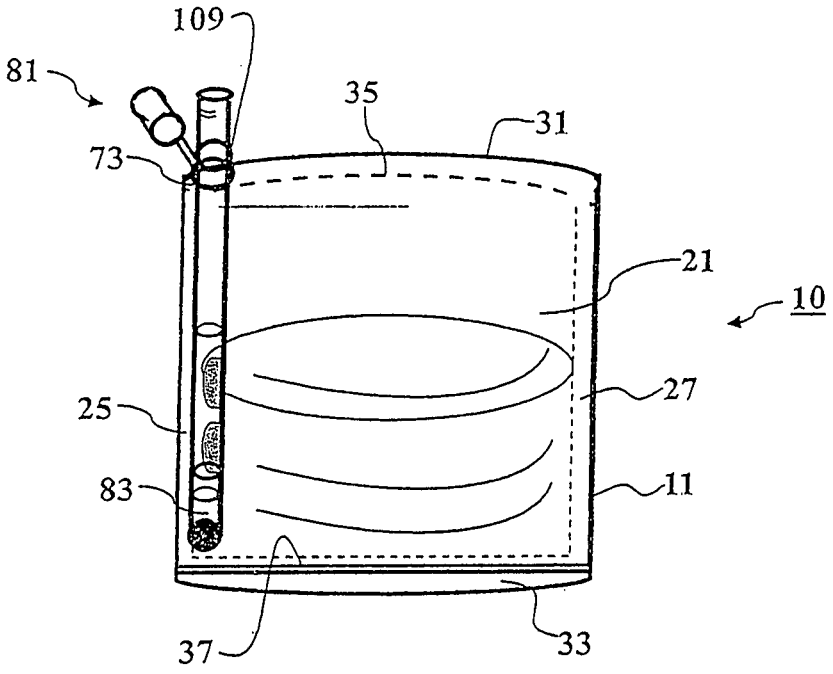
FIG. 1 is a front elevation view of an embodiment of the container with a straw.
Figure 2:
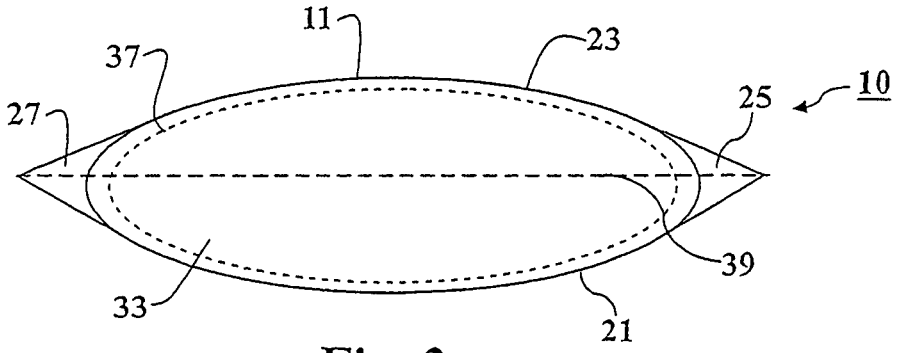
FIG. 2 is a bottom plan view of the container of FIG. 1.
Figure 3:
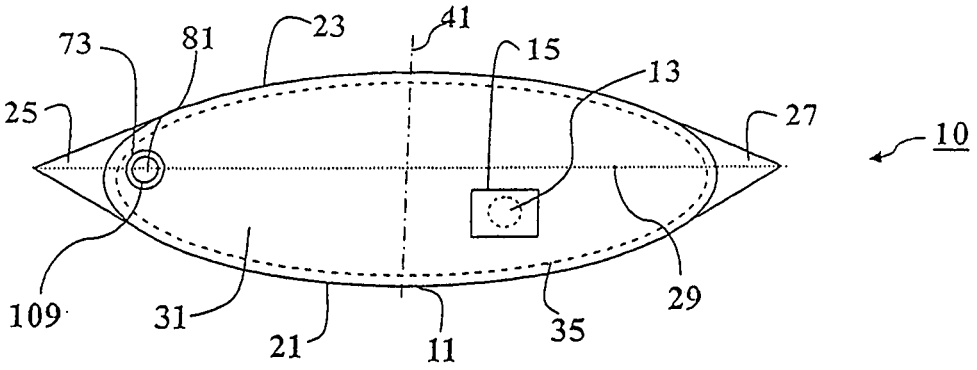
FIG. 3 is a top plan view of the container of FIG. 1.

Turning to FIGS. 1-3, a disposable container 10 for mixing and drinking liquids made by dissolving powdered ingredients or drink mixing ingredients in other than powdered form in water or other liquid is formed from a liquid-tight film pouch 11 which is collapsible into a substantially flat condition. The powdered drink ingredients, or drink mixing ingredients in other than powdered form, may be packaged in the pouch 11 or added to the pouch at the time of mixing. As seen in FIG. 3, the pouch 11 has a fill opening 13 in its upper portion and a means for closing 15 the fill opening with a liquid tight seal. The fill opening 13 provides access to the pouch 11 for introduction of the ingredients and liquid into the pouch 11 for mixing and may also be used for dispensing the mixed drink from the pouch 11. The location of the fill opening 13 and the contour of the closing means 15 are coordinated for conformance of the closing means 15 with the desired substantially flat condition of the pouch 11 in its storage condition.

Continuing to look at FIGS. 1-3, the pouch 11 has opposed front and rear panels 21 and 23 which are sealed together along their side edges 25 and 27 and top and bottom panels 31 and 33 which are sealed along their perimeters to the top and bottom perimeters 35 and 37 of the front and rear panels 21 and 23. As best seen in FIGS. 2 and 3, the top and bottom panels 31 and 33 fold across their widths into the substantially flat condition. As seen in FIG. 3, the fill opening 13 is in the top panel 31. The sealed top and bottom perimeters 35 and 37 of the pouch 11 are, as shown, preferably elliptical and fold along their major axes 29 and 39 so that the flat pouch 11 assumes a substantially ovate horizontal cross-section condition as it is being filled with liquid. As shown, the perimeter of the fill opening 13 is entirely on one side of the major axis 29 of the ovate cross-section. The fill opening 13 may, as seen in FIG. 3, be spaced from or, as seen in FIG. 5, be centered on, the minor axis 41 of the top panel 31.

Figure 4:
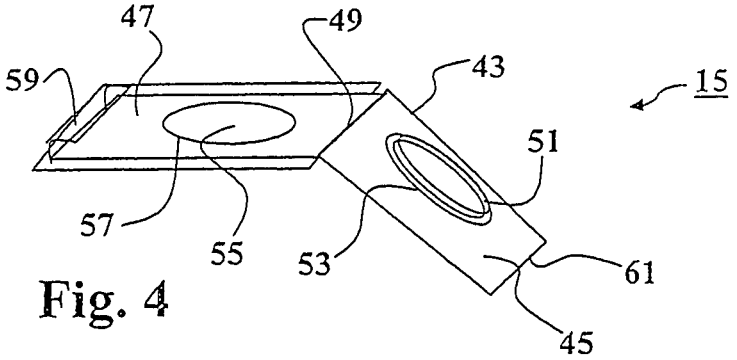
FIG. 4 is a perspective view of a flip-cap fill opening cover of the container of FIG. 1.

As seen in FIGS. 3 and 4, a flip-cap closing means 43 for the fill opening 13 has a pair of flat, thin rigid panels 45 and 47 connected by a hinge 49. One of the panels 45 has a plug 51 with a peripheral groove 53 and the other panel 47 has an opening 55 defining a collar 57 for co-operable engagement in the groove 53 of the plug 51 to resist inadvertent removal of the plug 51 from the fill opening 13. The collar 57 is dimensioned to concur with the fill opening 13 and the collar panel 47 is fixed to the pouch top panel 31 with the fill opening 13 and collar 57 aligned. The collar panel 47 also has a latch 59 which engages the unhinged end 61 of the plug panel 45 when the collar 57 and the perimeter of the fill opening 13 are engaged in the plug groove 53. The rigidity of the panels 45 and 47 facilitates manipulation of the flip-cap closure 43 and firm engagement of the plug 51 and latch 59. The location and substantially flat contour of the plug 51 permit conformance of the plug 51 to the substantially flat storage condition of the pouch 11 in both the plug-inserted condition and the plug-removed condition.

Figure 5:
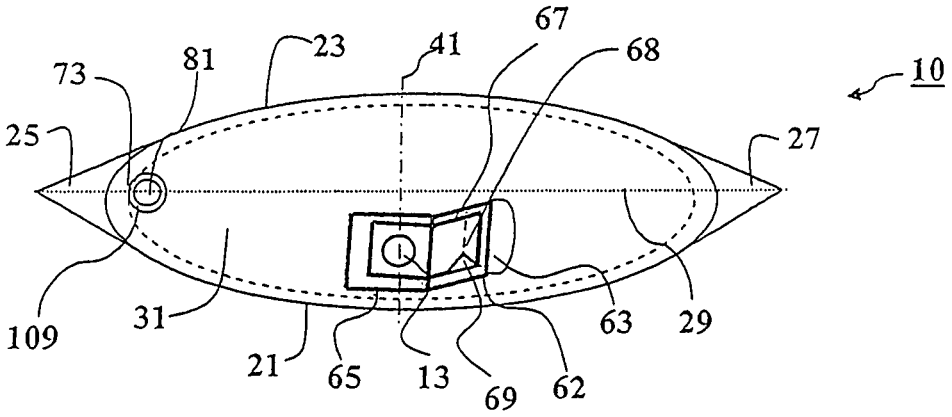
FIG. 5 is a top plan view of another embodiment of the container with an adhesive strip fill opening cover.

Looking at FIG. 5, the fill opening 13 may alternatively be covered by a flap 62 with a pull tab 63 having a base 65 permanently fixed to the container top panel 31. The base 65 has an opening aligned with the fill hole 13. The flap 62 initially closes the fill hole 13 by use of an outer adhesive seal 67. Once opened, a peel-off flap 68 can be removed to expose an inner adhesive seal 69 under the flap 68 used to close the opened fill hole 13. As shown, the fill opening 13 is disposed with its perimeter on one side of the major axis 29 of the pouch top panel 31 and centered on the minor axis 41 of the top panel 31.

Figure 7:
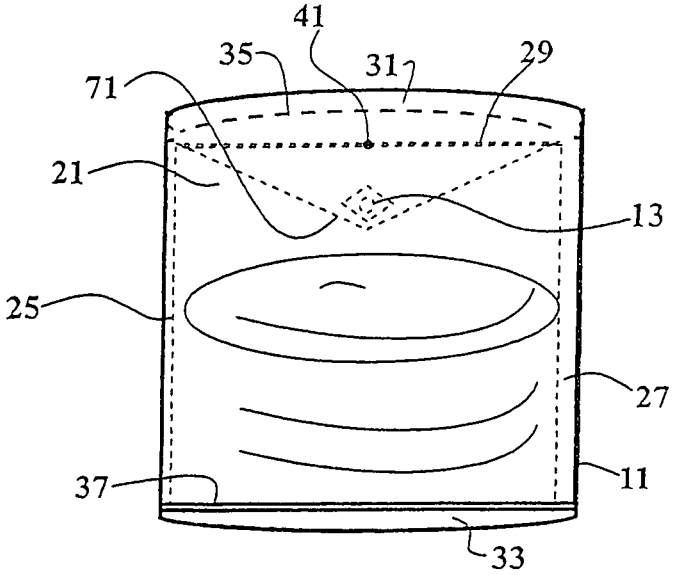
FIG. 7 is a front elevation view of another embodiment of the container without a straw.

As seen in FIGS. 3, 5 and 7, the same opening 13 can be used without a straw for both filling and dispensing and, for drinking without a straw, the top panel 31 may preferably be configured to provide a taper 71 to an opening below the minor axis 41 of the top panel 31. This facilitates manipulation of the pouch 11 during drinking and filling to an efficient flow configuration.

Figure 8:
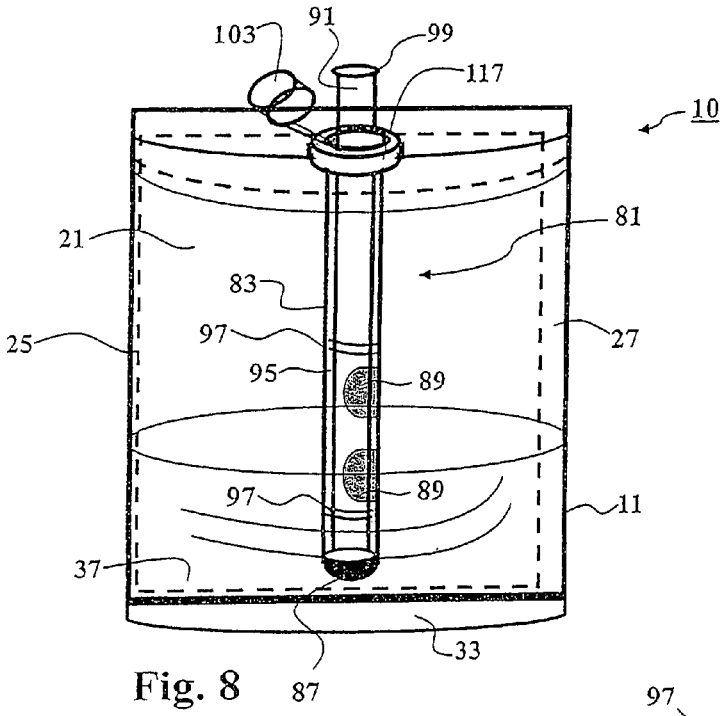
FIG. 8 is a front elevation view of another embodiment of the container with a straw.
Figure 9:
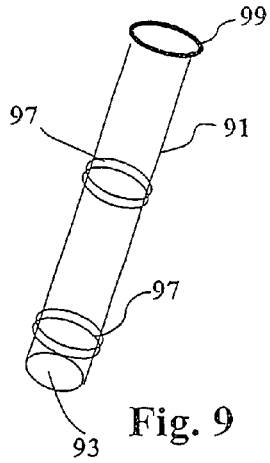
FIG. 9 is a perspective view of the inner tubular member of the straw of FIG. 8.
Figure 10:
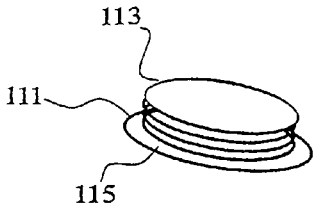
FIG. 10 is a perspective view of the fill hole insert of the container of FIG. 8.
Figure 11:
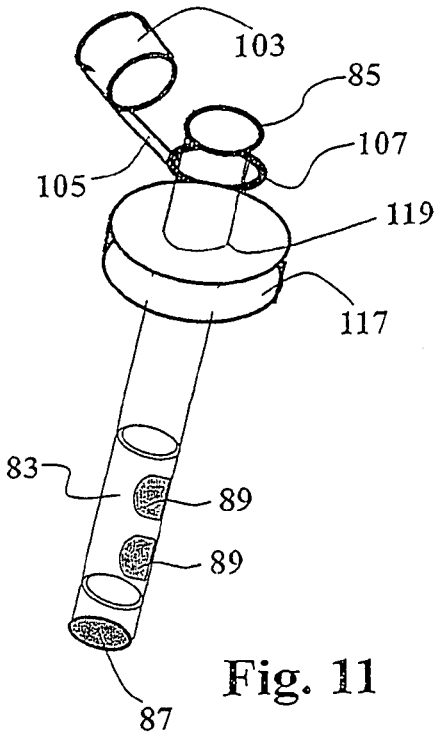
FIG. 11 is a perspective view of the outer tubular member and screw cap of the container of FIG. 8.
Figure 12:
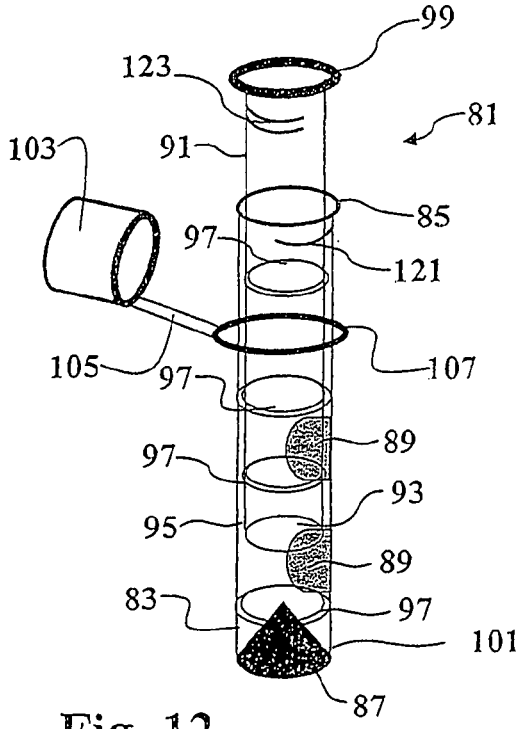
FIG. 12 is a perspective view of a conical seal embodiment of the straw.

Returning to FIG. 3, another opening 73 may be provided in the pouch 11, as shown proximate one end of the top panel 31 with its perimeter on the major axis 29 of the panel 31, for dispensing the mixed drink from the pouch 11. Looking at FIG. 1, a straw 81 extends through the dispense opening 73 to proximate the bottom panel 33 of the pouch 11. The straw 81, best seen in FIGS. 6 and 8-11, has an outer tubular member 83 with an open upper end 85 and a closed bottom end 87. At least one aperture 89 through the lower portion of the side wall of the outer tubular member 83 admits liquid from the pouch 11 into the outer tubular member 83. The straw 81 also has an inner tubular member 91 longer than the outer tubular member 83. The inner member 91 slides reciprocally in abutment within the outer tubular member 83 between a closed condition in which the open bottom 93 of the inner tubular member 91 is seated on the closed bottom 87 of the first tubular member 83 and an open condition in which the open bottom 93 of the inner tubular member 91 is positioned above the uppermost aperture 89 in the outer tubular member 83. In the closed condition, liquid cannot freely pass through the apertures 89 in the outer tubular member 83 into the annulus 95 between the tubular members 83 and 91 or into the bottom 93 of the inner tubular member 91 from the annulus 95. The resulting labyrinth effectively blocks flow of liquid into the inner tubular member 91. In the open condition, liquid passes freely through every aperture 89 in the outer tubular member 83 and into the bottom 93 of the inner tubular member 91. Between the open and closed conditions, liquid flows through exposed portions of the apertures 89 in the outer tubular member 83 into the bottom 93 of the inner tubular member 91. To further assure a seal of the annulus 95, means such as sets of mating annular rings and grooves 97 can be positioned on the abutting surfaces of the tubular members 83 and 91. In the closed condition, at least one annular ring and groove set 97, located below the lowermost aperture 89 in the outer tubular member 83, mate at the same time that the bottom 93 of the inner tubular member 91 seats on the bottom 87 of the outer tubular member 83. In the open condition, at least one mating annular ring and groove set 97 is located above the uppermost aperture 89 in the outer tubular member 83. Seal of the annulus 95 may be accomplished in other ways such as, for example as seen in FIG. 12, a conical protrusion 101 in the bottom 87 of the outer tubular member 83 can seat the open bottom 93 of the inner tubular member 91 in the closed condition. The open upper end 99 of the inner tubular member 91 can also be provided with a cap 103 to block upward flow of liquid through the inner tubular member 91. The cap 103 can be attached by a flexible connector 105 to a mounting ring 107 on the straw 81, as seen in FIGS. 6 and 8, or to the pouch 11, so that the upper end 99 of the inner tubular member 91 can be opened and closed as needed.

Going back to FIGS. 1 and 3, the junction of the perimeter of the dispense opening 73 with the perimeter of the outer tubular member 83 of the straw 81 preferably has a liquid flow preventing seal 109, perhaps accomplished by heat welding. Alternatively, as seen in FIGS. 8-11, an insert 111 with a threaded neck 113 aligned with the fill opening 13 of any embodiment and a base 115 fixed to the pouch 11 can be covered with a screw cap 117. Such a closure can be used to cover either the fill or dispense openings 13 or 73. In a straw type embodiment of the container 10, either the screw cap 117 is provided with an opening 119 which snugly girts the outer tubular member 83 of the straw 81 or the screw cap 117 is integrally molded with the outer tubular member 83 of the straw 81. The structure and operation of the tubular members 83 and 91 is otherwise substantially as hereinbefore described. The open upper end 99 of the inner tubular member 91 can also be covered with its own cap 103, also as hereinbefore described.

Figure 6:
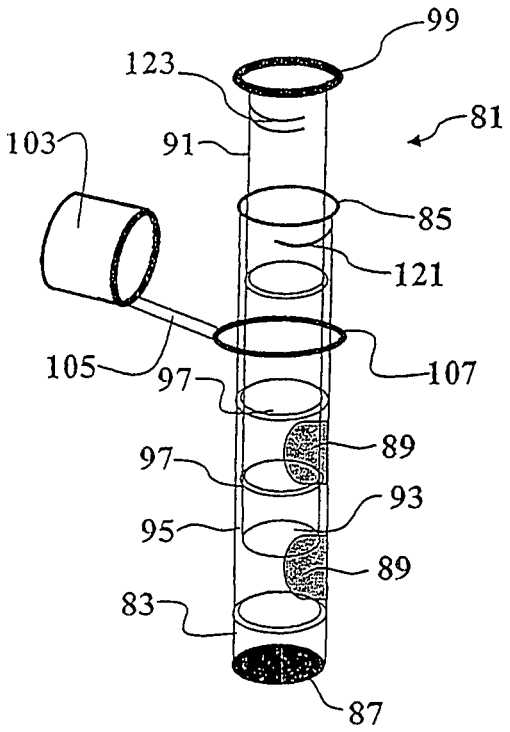
FIG. 6 is a perspective view of a typical straw for use with various embodiments of the container.

The tubular members 83 and 91 may also be locked in the closed condition, for example and as shown in FIG. 6, by use of mating male and female threads 121 and 123 on abutting surfaces of the tubular members 83 and 91 so that, in the closed condition, the inner tubular member 91 can be rotated into a sealed threaded engagement with the outer tubular member 83.

The locations of openings 13 and 73, the use of a straw 81 and the types of opening covers 43 and 63 illustrated herein are interchangeable to achieve a variety of containers in keeping with the invention. The thickness, location and orientation of the straw 81 and the various covers 43 and 63 and caps 103 and 117 described above allow the container to maintain its desired substantially flat storage condition. In the screw cap straw embodiment of FIG. 8, it may be desirable to remove the tubular members 83 and 91 from the cap 117 for storage so that the base 115 of the insert 111 will follow the fold 29 of the top panel 31 of the pouch 11 into the storage condition.

Turning to FIGS. 13-17, a preferred embodiment of the straw is illustrated. The straw 200 has an outer tubular member 210, an inner tubular member 250 and a cap 270.

The Outer Tubular Member

Figure 13:
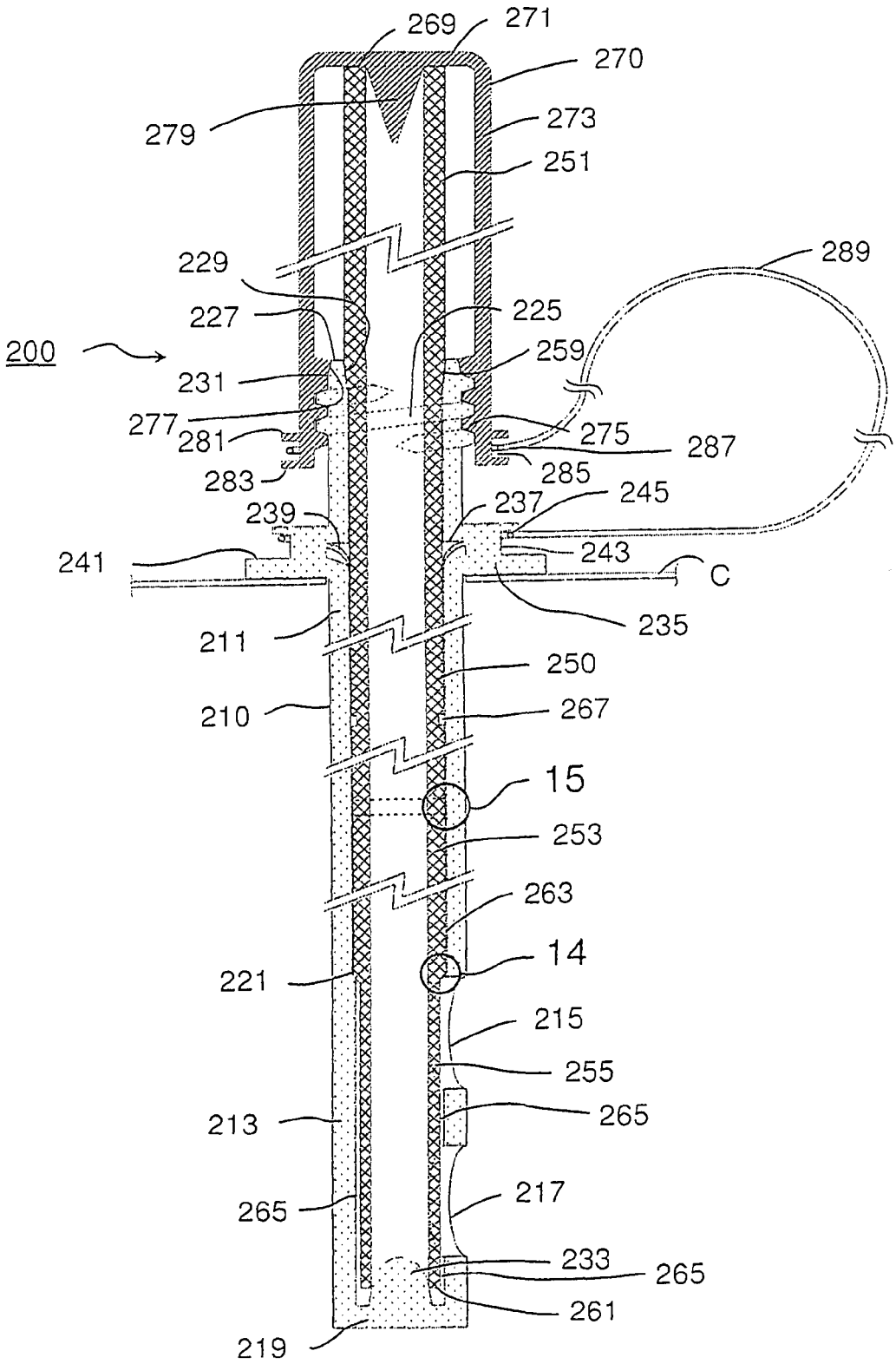
FIG. 13 is a cross-sectional view of a preferred embodiment of the straw in the fully closed condition taken along a diametric plane bisecting the outer tubular member apertures and extending through the cap tether with the straw.
Figure 14:
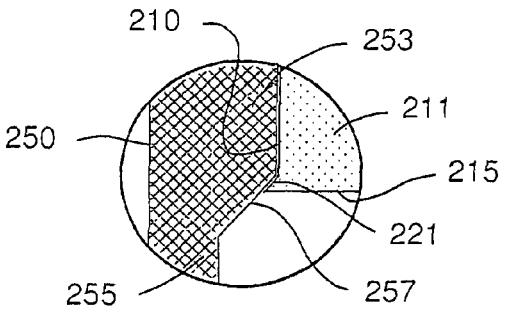
FIG. 14 is an enlarged view of the area 14 of FIG. 13.
Figure 15:
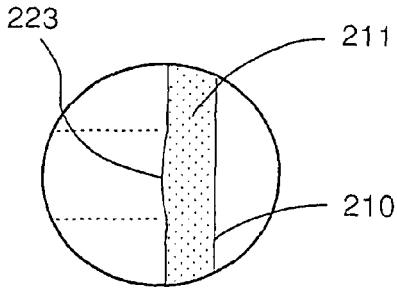
FIG. 15 is an enlarged view of the area 15 of FIG. 13.

Looking at FIG. 13, the outer tubular member 210 has a constant outer diameter, an upper portion 211 of constant inner diameter and a lower portion 213 of constant inner diameter smaller than the inner diameter of the upper portion 211. At least two apertures, as shown upper and lower large apertures 215 and 217, are vertically spaced and aligned proximate the closed bottom 219 of the outer tubular member 210 to admit liquid from the container C into the straw. The apertures 215 and 217 are ovate with their major axes aligned coaxially with the outer tubular member 210. The decrease in inner diameter is accomplished by an inside wall taper 221 at the top of the upper aperture 215, best seen in FIG. 14. As best seen in FIG. 15, the outer tubular member 210 also has an inside wall annular bubble or bead 223 spaced above the taper 221.

The outer tubular member 210 has external threads 225 at its top end 227. Inside and outside wall tapers 229 and 231 gradually narrow the thickness of the upper portion 211 of the outer tubular member 210 at its top end 227. The closed bottom end 219 of the outer tubular member 210 has a dome-like protrusion 233 which extends upwardly into the outer tubular member 210.

Figure 16:
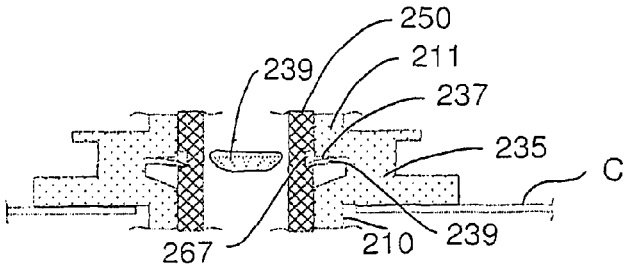
FIG. 16 is a front elevation view illustrating the withdrawal limiting mechanism at the predetermined withdrawal limit of the straw.

As best seen in FIGS. 13 and 16, the outer tubular member 210 also has an annular flange 235 proximate and below its external threads 225. The annular flange 235 is thick enough to house an annular groove 237 in the inside wall of the outer tubular member 210. A ring of resiliently flexible tabs 239 extends radially inwardly from the circumferential back wall of the annular groove 237. As is seen in FIG. 16, when no force is applied to the tabs 239, the tabs 239 extend beyond the inner diameter of the upper portion 211 of the outer tubular member 210. The upper surfaces of the tabs 239 in the no-force applied condition of FIG. 16 abut the top wall of the groove 237. The bottom wall of the groove 237 is downwardly sloped, so the tabs 239 can flex between a downwardly arced condition entirely within the groove 237, as seen in FIG. 13, and a substantially horizontal condition protruding from the groove 237, as seen in FIG. 16. The annular flange 235 shown has a wide diameter base 241 to facilitate mounting the straw on the container C and a channel 243 in its outer circumference above the base 241 for securing an O-ring-like member 245 to the outer tubular member 210.

Figure 17:
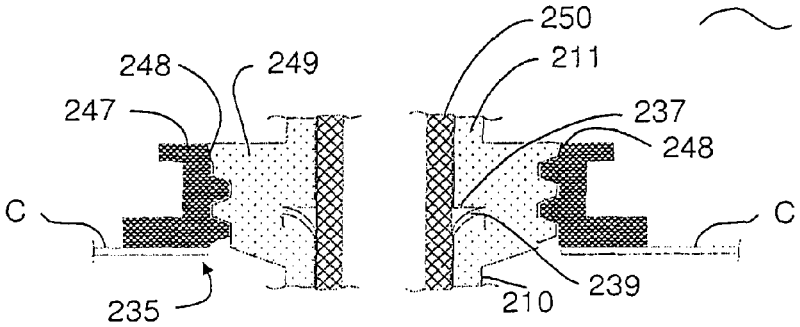
FIG. 17 is a front elevation view illustrating a modification of the flange connecting the straw of FIG. 13 to a container.

As seen in FIG. 17, illustrating a modification of the flange 235, the flange 235 may be formed in two mating segments 247 and 249. As shown, the outer and inner segments 247 and 249 are threadedly engaged. Other engagement methods, such as a tab-slot combination, could be used. Because of the mating combination, there is no need for a separate fill hole in the top panel of the container C. Filling the container C can be accomplished by unscrewing or otherwise separating the mated flange segments 247 and 249, removing the detached portion of the straw with the inner portion 249 of the flange 235 from the container C, filling the container C through the opening resulting from the removal of the inner portion 249 of the flange 235 and reinstalling the straw and inner flange 249 in the outer flange portion 247. As shown, mating tapered surfaces 248 may be provided on the top of the flange portions 247 and 249 to seal against leakage of liquid when the flange portions 247 and 249 are fully screwed together or otherwise engaged.

The Inner Tubular Member

As seen in FIG. 13, the inner tubular member 250, which is longer than the outer tubular member 210, has a constant inner diameter, an upper portion 251 of constant outer diameter, an intermediate portion 253 of constant outer diameter smaller than the outer diameter of the upper portion 251 and a lower portion 255 of constant outer diameter smaller than the outer diameter of the intermediate portion 253. The outer diameter of the intermediate portion 253 of the inner tubular member 250 is such that the intermediate portion 253 of the inner tubular member 250 is reciprocally slidable in abutment within the upper portion 211 of the outer tubular member 210. Preferably, the outer diameter of the intermediate portion 253 is so coordinated to the inner diameter of the outer tubular member 210 as to allow reciprocation of the inner tubular member 250 with minimal exertion of force while maximizing the resistance to flow of liquid between the outer tubular member 210 and the inner tubular member 250.

The decreases in outer diameter of the inner tubular member 250 are accomplished by outside wall tapers 257 and 259. Looking at FIG. 14, the lower taper 257 is positioned to mate with the taper 221 at the top of the upper aperture 215 of the outer tubular member 210 when the open bottom end 261 of the inner tubular member 250 is fully seated on the dome-like protrusion 233 on the closed bottom end 219 of the outer tubular member 210. In this, the fully closed condition, the dome-like protrusion 233 seals the otherwise open bottom end 261 of the inner tubular member 250 and the mating tapers 221 and 257 on the outer and inner tubular members 210 and 250 seals off the annulus 263 between the tubular members 210 and 250 above the mating tapers 221 and 257. The narrower diameter at the lower portion 255 of the inner tubular member 250 affords a concentric space 265 in the annulus 263 below the mating tapers 221 and 257 and across the apertures 215 and 217 in the outer tubular member 210 to prevent creation of a vacuum between the tubular members 210 and 250 as the inner tubular member 250 is withdrawn and to facilitate immediate flow of liquid through the apertures 215 and 217 into the open bottom end 261 of the inner tubular member 250 as soon as the straw is not in the fully closed condition. Looking at FIG. 13, the upper taper 259 of the inner tubular member 250 is positioned to mate with the taper 229 at the top end 227 of the outer tubular member 210 when the open bottom end 261 of the inner tubular member 250 is fully seated on the dome-like protrusion 233 on the closed bottom end 219 of the outer tubular member 210. This mating seals the annulus 263 to prevent leakage of any fluid at the top end 227 of the outer tubular member 210.

An annular slot 267 is positioned in the outside wall of the intermediate portion 253 of the inner tubular member 250. Preferably, the slot 267 is above the annular bead 223 on the inside wall of the outer tubular member 210 and below the flange 235 on the outer tubular member 210 when the straw is in the fully closed condition as seen in FIG. 13. The bead 223 seals the annulus 263 against flow of liquid when the inner tubular member 250 is withdrawn from the fully closed condition. As the inner tubular member 250 is withdrawn, the slot 267 will slide upwardly only until it comes into alignment with the ring of tabs 239 on the outer tubular member 210. At this point, as seen in FIG. 16, the tabs 239 will flap upwardly into the slot 267 until the top surfaces of the tabs 239 abut the top surface of their groove 237 in the outer tubular member 210 and the bottom surface of the slot 267 abuts the bottom surfaces of the tabs 239, preventing further withdrawal of the inner tubular member 250. Thus, the elevations of the tabs 239 and slot 267 on their respective tubular members 210 and 250 set the predetermined limit beyond which the inner tubular member 250 cannot be withdrawn. Preferably, when the inner tubular member 250 is withdrawn to the maximum limit, the open bottom end 261 of the inner tubular member 250 will still be substantially below the annular groove 237 in the outer tubular member 210. It is also preferred that, at this maximum withdrawal, the inner tubular member 250 will have been extended approximately 2" above the fully closed condition.

The inner tubular member 250 has an open top end 269 at which a consumer applies suction to draw liquid from the container C when the straw is not in the fully closed condition.

The Cap

As seen in FIG. 13, the cap 270 has a top 271 and sidewalls 273 with internal threads 275 on the open bottom of the cap 270. The internal threads 275 mate with the external threads 225 on the outer tubular member 210 to close the straw and seal against leaking to the outside of the cap 270. The cap 270 has an inside taper 277 immediately above the internal threads 275 which mates with the outside wall taper 231 at the top end 227 of the outer tubular member 210 to further assure the tight seal of the cap 270. Furthermore, if, as shown, the inner tubular member 250 has an upper portion 251 which extends into the cap 270, the top end 227 of the outer tubular member 210 will be squeezed between the pairs of taper 259 and 277 on the inner tubular member 250 and the cap 270 in the fully closed condition to enhance the seal.

The height of the cap 270 is such that top 271 of the cap 270 will close the open top end 269 of the inner tubular member 250 in the fully closed condition. A plug 279, as shown an inverted cone, extends downwardly from the top 271 of the cap 270 into the open top end 269 of the inner tubular member 250 to enhance this seal in the fully closed condition. In this configuration, tightening of the complementary threads 275 and 225 on the inside of the cap sidewalls 273 and the outside of the outer tubular member 210 draws the cap plug 279 and the closed bottom end 219 of the outer tubular member 210 toward each other. This simultaneously seals the open top and bottom ends 269 and 261 of the inner tubular member 250 in the fully-closed condition. At the same time, the co-operating tapers 221 and 257 on the outer and inner tubular members 210 and 250 and the annular bead 223 seal the annulus 263.

Annular flanges 281 and 283 on the cap 270 provide a channel 285 for securing an O-ring-like member 287 to the cap 270. A tether 289 extends between the outer tubular member O-ring-like member 245 and the cap O-ring-like member 287 so that the cap 270 will not be inadvertently lost. The tether 289 should be long and flexible enough to facilitate complete and easy application and removal of the cap 270.

The annular bead 223 could be on the outside wall of the inner tubular member 250 rather than on the inside wall of the outer tubular member 210. The various seals at the mating pairs of tapers 221 and 257, 229 and 259 and 231 and 277, at the bead 223, at the bottom end dome-like member 233, at the cap plug 279 and at the mating taper 248 of a two piece flange should be capable of preventing leakage when the liquid filled container is subjected to a minimum pressure predetermined according to intended use.

Straw with Slotted Outer Tubular Member

Figure 19:
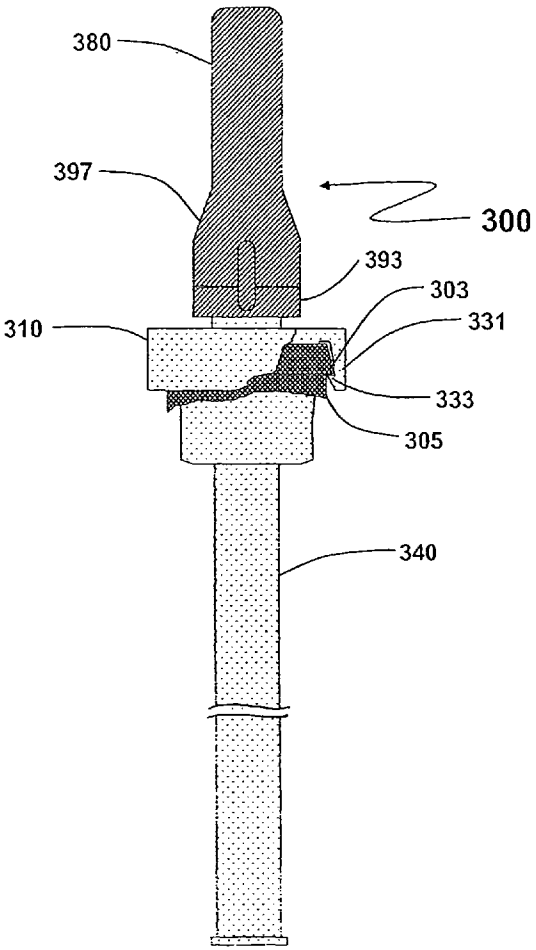
FIG. 19 is a side elevation view with parts broken away of the straw of FIG. 18.
Figure 18:
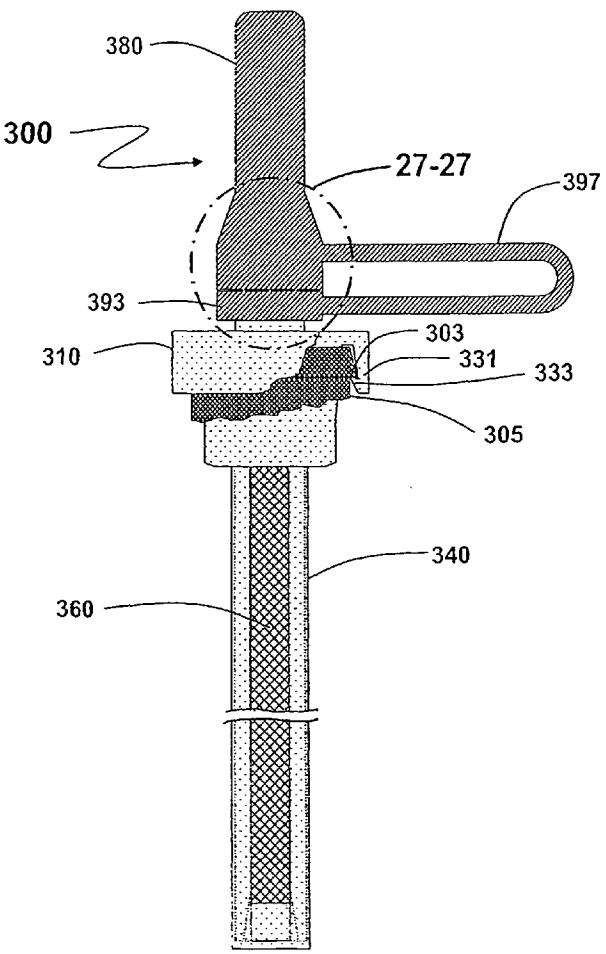
FIG. 18 is a front elevation view with parts broken away of another embodiment of the straw.
Figure 20:
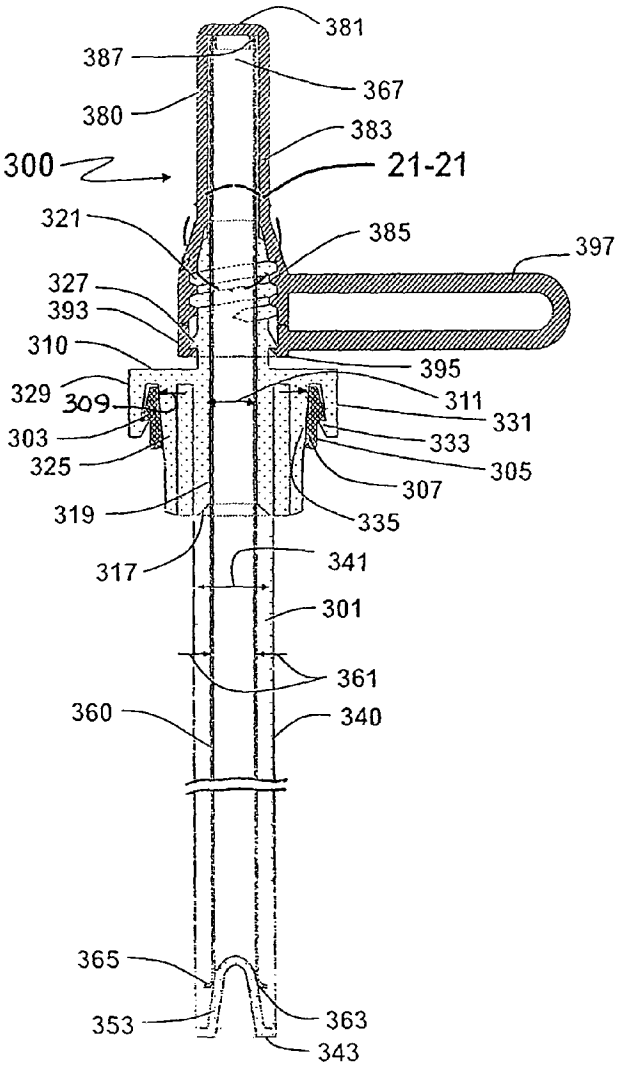
FIG. 20 is a diametric cross-sectional view of the straw of FIG. 18.
Figure 25:
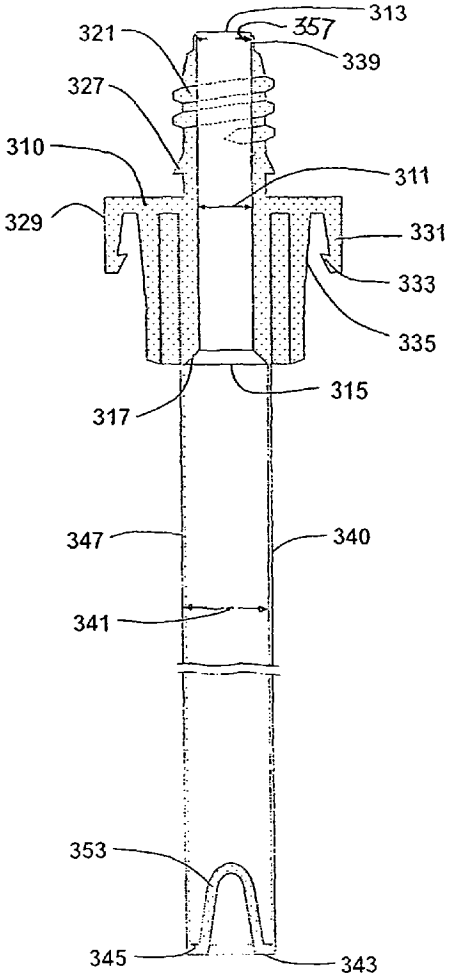
FIG. 25 is a diametric cross-sectional view transverse to the diametric view of FIG. 20.
Figure 23:
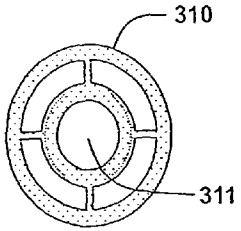
FIG. 23 is a cross-sectional view taken along the line 23-23 of FIG. 22.
Figure 24:
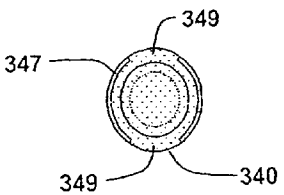
FIG. 24 is a cross-sectional view taken along the line 24-24 of FIG. 22.
Figure 22:
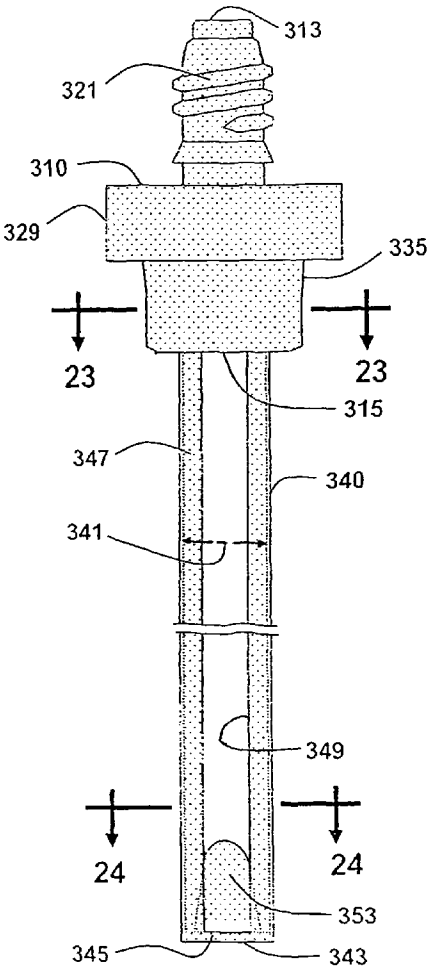
FIG. 22 is a front elevation view of the body and outer tubular member of the straw of FIG. 18.
Figure 27:
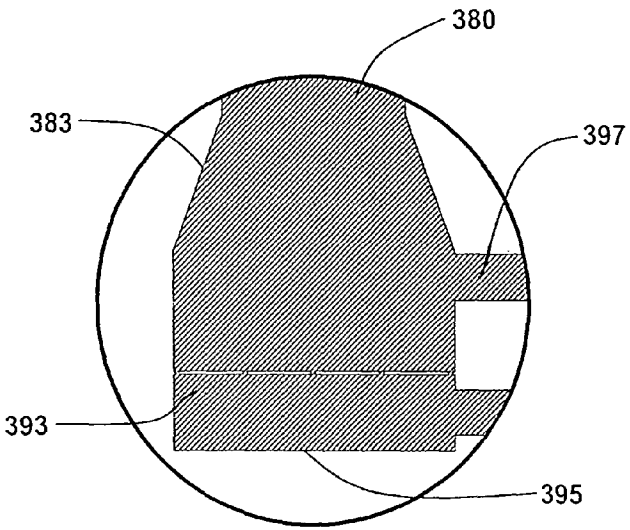
FIG. 27 is an exploded view of the area 27-27 of FIG. 18.

Turning to FIGS. 18-27, another embodiment of the straw is illustrated. As seen in FIGS. 18-20, the straw 300 has a body 310, an outer tubular member 340, an inner tubular member 360 and a cap 380.

The body 310 and outer tubular member 340 are best seen in FIGS. 22-25. The body 310 has a passage 311 extending longitudinally through it from top 313 to bottom 315. The outer tubular member 340 depends from the body 310 and has a passage 341 aligned and in communication with the passage 311 through the body 310. The bottom end 343 of the outer tubular member 340 is closed by a wall 345. The side wall 347 of the outer tubular member 340 has at least one, and as shown two diametrically opposed, longitudinal slots 349 which extend from the bottom 315 of the body 310 to the bottom end 343 of the outer tubular member 340.

Figure 26:
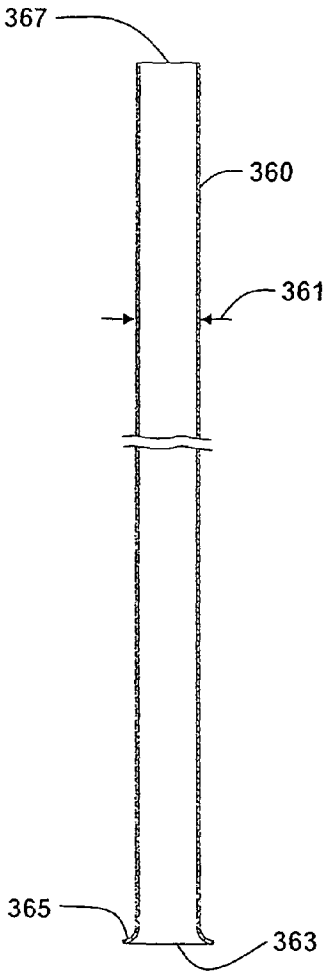
FIG. 26 is a diametric cross-sectional view of the inner tubular member of the straw of FIG. 18.

The inner tubular member 360, best seen in FIG. 26, extends through the body passage 311 into the outer tubular member passage 341, as seen in FIGS. 18-21. The outer diameter 361 of the inner tubular member 360 is such as to be engaged in and snugly reciprocally slide in the body passage 311. The outer diameter 361 of the inner tubular member 360 and the inner diameter 341 of the outer tubular member 340 are such as to create an annular passage 301 between them.

The inner tubular member 360 reciprocates between a fully-closed condition, as seen in FIG. 20, in which the open bottom end 363 of the inner tubular member 360 is seated on the closed bottom end 343 of the outer tubular member 340, and a fully-opened condition in which the open bottom end 363 of the inner tubular member 360 is raised above the closed bottom end 343 of the outer tubular member 340. The slots 349 in the outer tubular member 340 allow liquid to enter the lower part of the inner tubular member 360 as it is withdrawn to the fully-opened condition.

Preferably, looking at FIG. 20, the closed bottom end 343 of the outer tubular member 340 has an upwardly extending dome-like protrusion 353 which at least partially inserts into and mates with the open bottom end 363 of the inner tubular member 360 to provide a seal against flow of liquid into the open bottom end 363 of the inner tubular member 360 in the fully-closed condition. Also preferably, an outward flare 365 on the open bottom end 363 of the inner tubular member 360 cooperates with the dome-like protrusion 353 to provide the seal in the fully-closed condition. During withdrawal of the inner tubular member 360 from the outer tubular member 340, the flare 365 will eventually mate with a tapered surface 317 on an inner wall 319 of the body 310 to prevent further withdrawal of the inner tubular member 360 from the body 310.

Figure 21:
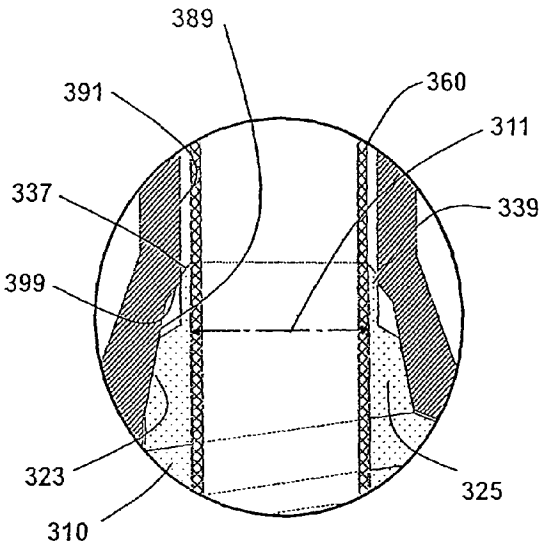
FIG. 21 is an exploded view of the area 21-21 of FIG. 20.

Turning to FIGS. 18-20 and 27, the cap 380 has a top 381 and sidewalls 383 and covers the open top end 367 of the inner tubular member 360. In the embodiment shown, complementary threads 385 and 321 on the inside of the cap sidewalls 383 and the outside of the body 310 draw the cap 380 and the closed bottom end 343 of the outer tubular member 340 toward each other during tightening rotation of the threads 385 and 321. Complementary slots and tabs (not shown) could be used in place of the complementary threads 385 and 321. A plug 387, best seen in FIG. 20, in the top of the cap 380 is inserted into the open top end 367 of the inner tubular member 360 as the straw 300 comes into the fully closed condition. Thus the cap plug 387 and outer tubular member closed bottom 343 simultaneously seal the open top and bottom ends 367 and 363 of the inner tubular member 360 when the straw 300 is in the fully-closed condition. Referring to FIG. 21, complementary tapers 323 and 389 on the outside wall 325 of the body 310 above the threads 321 and on the inside wall 391 of the cap 380 above the threads 385 are also drawn into abutment with each other to provide a seal between the cap 380 and the body 310 when the straw 300 is in the fully-closed condition.

Looking at FIG. 20, an annular flange 327 is preferably provided on the body 310 below the threads 321 and the cap 380 has a breakaway portion 393 on its bottom end 395 engaged on the flange 327. The breakaway portion 393 engages on the flange the first time the cap 380 is screwed onto the body 310. The breakaway portion 393 is separated from the cap 380 the first time the cap 380 is unscrewed from the body 310 to provide "tampering" evidence to a purchaser. The breakaway portion 393 is retained on the straw 300 by the flange after separation. A tether 397 connects the cap 380 to its retained breakaway portion 393 so the cap 380 will always be available to recover the straw 300. Alternatively, a tear-away wrap (not shown) covering the lower portion of the cap 380 and the upper portion of the body 310 could be used to provide tamper-evident protection.

As best seen in FIG. 21, the seal between the body 310 and the inner tubular member 360 in the fully-closed condition of the straw 300 is assured by complementary tapered surfaces 337 and 399 on a thin upper rim 339 of the body 310 and on the inside wall 391 of the cap 380. The cap taper 399 cooperates with body rim taper 337 to compress the thin rim 339 of the body 310 against the outer diameter 361 of the inner tubular member 360 to create the seal.

The outside wall 325 of the body 310 is adapted for liquid-tight connection to a liquid container fitment 305 with the outer tubular member 340 inside the container and the upper portion 329 of the body 310 outside of the container. For example, and as shown in FIGS. 18-20, the container fitment 305 has a tapered inside wall with external tabs 303 which engage with corresponding internal circumferential tabs 333 on a complementary snap-type connector 331 on the body 310 to lock the straw 300 to the container. Other configurations of tabs and types of connections between the container fitment 305 and the body connector 331, such as complementary threads on the fitments, could be used. As shown, complementary tapers 335 and 307 on the body 310 and on the container fitment 305 preferably extend over a substantial portion of the body 310 so as to assure a liquid tight seal between the body 310 and the container fitment 305.

The container fitment 305 may be as hereinbefore described, a part of a top panel of a container, such as by thermo-welding the fitment 305, to the panel of a collapsible container. Alternatively, the container fitment 305 may be installed as a completion of a container without a top panel, such as by thermo-welding to the inside top portions of the front and back panels of a collapsible container. The lower portion of the body connector 331 can be any size and shape compatible with thermo-welding equipment used for installing fitments into or onto collapsible containers as long as it accommodates a circular opening of the proper size at its center for introduction of liquid into the container.

Powdered drink mix, water purification tablets and/or other dry components can be introduced into the container by injection through the passage in the container fitment 305 or into the container directly prior to installing the container fitment 305. During assembly of the straw 300, the sections of the outer tubular member 340 formed by the two diametrically opposed longitudinal slots 349 in the outer tubular member 340 should be spread apart enough for insertion of the inner tubular member 360. Various methods of assembling the straw 300 could be used. By way of example, the sections of the outer tubular member 340 formed by the two diametrically opposed longitudinal slots 349 in the outer tubular member 340 could be positioned and spread apart enough for insertion of the inner tubular member 360. Also by way of example, the bottom portion of the outer tubular member 340 with the dome-like protrusion 353 could be molded separately from the remaining portion of the outer tubular member 340 and, after insertion of the inner tubular member 360 through the open bottom end of the outer tubular member 340, connected to the outer tubular member 340 by thermowelding, snap-in or screw-in methods. Also by way of example, the bottom end of the inner tubular member 360 could be flared after insertion into the body 310 and outer tubular member 340 by insertion of a heated flaring tool through one of the slots 349 of the outer tubular member 340.

By way of example, it is anticipated that one operable configuration of the straw 300 for use with a collapsible container would have a polypropylene or high density polyethylene container fitment 305, an integral polypropylene or high density polyethylene body 310, an integral extended polypropylene inner tubular member 360 with end flared and outer tubular member 340 and a high density polyethylene or polypropylene cap 380. The body 310 would be approximately 0.53" high and have a circumferential shoulder 371, a neck 373 approximately 0.45" high, a thin rim 339 with an approximately 0.008" wall thickness and an inner diameter or passage 311 approximately 0.001" greater than the inner tubular member outer diameter 361. The inner tubular member 360 would be approximately 4.3" long, have an outer diameter 361 of approximately 0.15" and have approximately 0.008" wall thickness. Preferably, the inner diameter 357 at the top of the rim 339 will taper to be equal or slightly less than the outer diameter 361 of the inner tubular member 360, so as to assure a snug engagement of the inner tubular member 360 with the rim 339. The lengths of the outer tubular member 340 and the inner tubular member 360 are determined only by the desired maximum distance the inner tubular member 360 can be withdrawn from the body 310. The exemplary outer tubular member 340 would have a length of approximately 2.75" and a wall thickness of approximately 0.012". The container fitment 305 would have an approximately 0.5" diameter passage 309 to accommodate filling.

Figure 28:
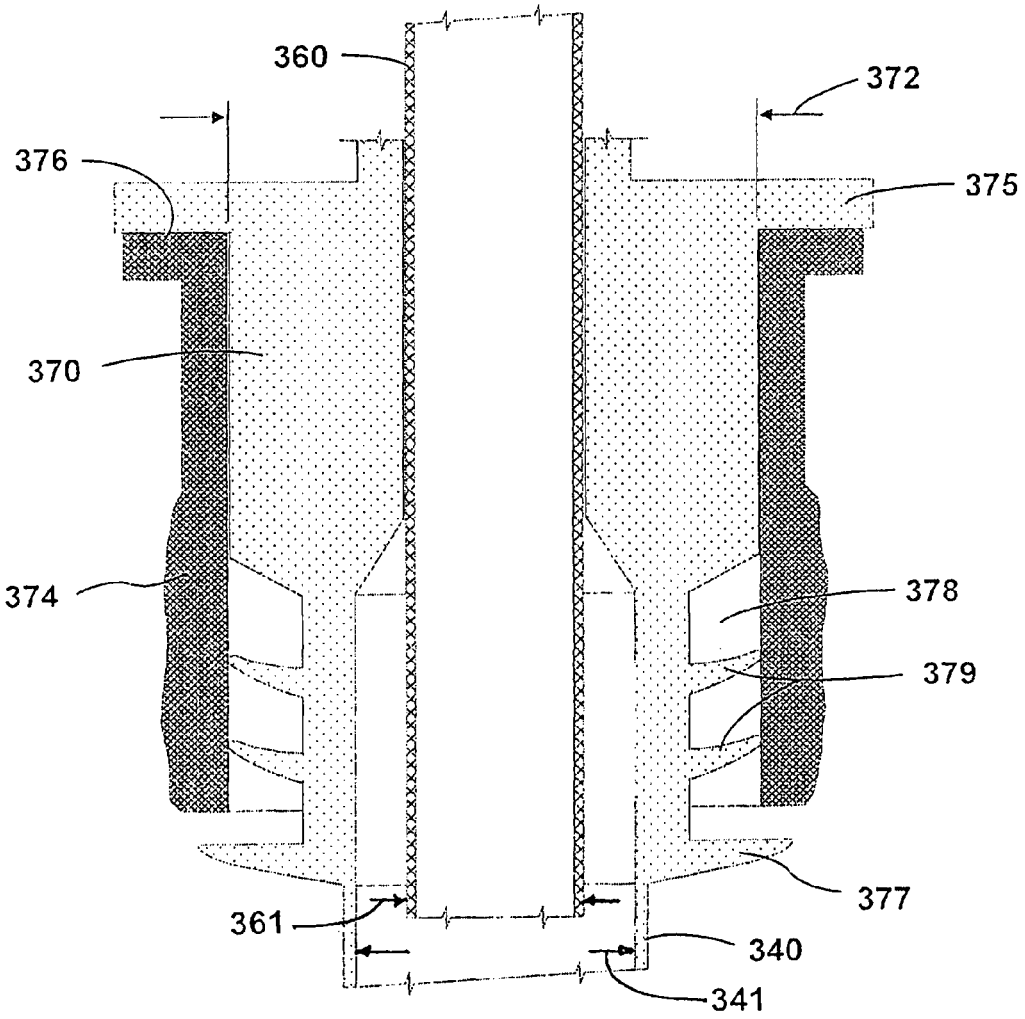
FIG. 28 is an exploded diametric cross sectional view with parts broken away of an alternate embodiment of the body and an associated container fitment.

Turning to FIG. 28, in an alternate embodiment of the body, a body 370 has a generally cylindrical contour for a snug but sliding fit into the inner diameter 372 of the container fitment 374. The lower part of the body 370 tapers to a narrower diameter cylindrical contour to form an annular gap 378 between the narrower body diameter and the container fitment 374. An annular flange 375 on the upper rim of the body 370 will engage against the top 376 of the container fitment 374 to limit the depth of insertion of the body 370 into the container fitment 374. An annular anti-removal ring 377 is provided on the lower rim of the body 370. At least one, and as shown two, annular sealing rings 379 are provided on the narrower portion of the body 370 above the anti-removal ring 377. The rings 377 and 379 are flexible. The anti-removal ring 377 has a substantially greater diameter than the inner diameter 372 of the container fitment 374. The sealing rings 379 have a slightly greater diameter than the inner diameter 372 of the container fitment 374. When the body 370 is pushed fully into the container fitment 374, the anti-removal ring 377 releases from the container fitment 374 and expands to its greatest diameter. Using this alternate body 370, removal of the straw from the container fitment 374 is prevented by the engagement of the upper surface of the anti-removal ring 377 against the bottom surface of the container fitment 374 when a removal attempt is made. The liquid seal is also achieved as the body 370 is pushed fully into the container fitment 374. The sealing rings 379 flex to make sealing contact against the inner diameter 372 of the container fitment 374. As seen in FIG. 28, the sealing rings 379 are positioned on the body 370 so that the seal is maintained whether the body 370 is pushed into the container fitment 374 until the body flange 375 strikes the top 376 of the container fitment 374 or the body 370 is withdrawn from the container fitment 374 until the anti-removal ring 377 strikes the bottom of the container fitment 374.

Thus, it is apparent that there has been provided, in accordance with the invention, a disposable collapsible powdered drink mixing container and telescoping straw that fully satisfy the objects, aims and advantages set forth above. While the invention has been described in conjunction with specific embodiments thereof, it is evident that many alternatives, modifications and variations will be apparent to those skilled in the art and in light of the foregoing description. Accordingly, it is intended to embrace all such alternatives, modifications and variations as fall within the spirit of the appended claims.

What is claimed is:

1. A straw comprising:

a body having a longitudinal passage therethrough;

an outer tubular member depending from said body, said outer tubular member having a closed bottom end and at least one longitudinal slot through a side wall thereof;

an inner tubular member extending downwardly into said outer tubular member with an annular passage therebetween and extending upwardly through said body passage and engaged thereby to snugly reciprocally slide therein between a fully-closed condition with an open bottom end of said inner tubular member seated on a closed bottom end of said outer tubular member and a fully-opened condition with said open bottom end of said inner tubular member above said closed bottom end of said outer tubular member;

means for plugging said open top end of said inner tubular member; and means for engaging and disengaging said means for plugging to and from a top portion of said body, said means for engaging and disengaging drawing said means for plugging said open top end of said inner tubular member and said closed bottom end of said outer tubular member toward each other during engagement of said means for plugging with said open top end of said inner tubular member to simultaneously seal said open top and bottom ends of said inner tubular member in said fully-closed condition.

2. A straw comprising:

a body having a longitudinal passage therethrough;

an outer tubular member depending from said body, said outer tubular member having a closed bottom end and at least one longitudinal slot through a side wall thereof; and an inner tubular member extending downwardly into said outer tubular member with an annular passage therebetween and extending upwardly through said body passage and engaged thereby to snugly reciprocally slide therein between a fully-closed condition with an open bottom end of said inner tubular member seated on a closed bottom end of said outer tubular member and a fully-opened condition with said open bottom end of said inner tubular member above said closed bottom end of said outer tubular member;

a cap having a top and sidewalls;

a plug in said top of said cap for insertion into said open top end of said inner tubular member; and complementary threads on an inside of said cap sidewalls and an outside of said body for drawing said cap plug and said closed bottom end of said outer tubular member toward each other during tightening rotation of said threads to simultaneously seal said open top and bottom ends of said inner tubular member in said fully-closed condition.

3. A straw according to claim 2 further comprising:

an annular flange on said body below said threads; and said cap having a breakaway portion on a bottom end thereof engaged on said flange whereby said breakaway portion is separated from said cap as said complementary threads are disengaged.

4. A straw according to claim 3 further comprising a tether connected between said cap and said cap breakaway portion.

5. A straw according to claim 2 further comprising means for providing a seal between said cap and said body when the straw is in said fully-closed condition.

6. A straw according to claim 5, said means for providing a seal comprising:

a first taper on an outside wall of said body above said threads; and a second taper on an inside wall of said cap above said threads;

said tapers being complementary and drawn into abutment with each other when the straw is in said fully-closed condition.

7. A straw comprising:

a body having a longitudinal passage therethrough;

an outer tubular member depending from said body, said outer tubular member having a closed bottom end and at least one longitudinal slot through a side wall thereof;

an inner tubular member extending downwardly into said outer tubular member with an annular passage therebetween and extending upwardly through said body passage and engaged thereby to snugly reciprocally slide therein between a fully-closed condition with an open bottom end of said inner tubular member seated on a closed bottom end of said outer tubular member and a fully-opened condition with said open bottom end of said inner tubular member above said closed bottom end of said outer tubular member;

a cap having a top and sidewalls;

a plug in said top of said cap for insertion into said open top end of said inner tubular member;

complementary threads on an inside of said cap sidewalls and an outside of said body for drawing said cap plug and said closed bottom end of said outer tubular member toward each other during tightening rotation of said threads to simultaneously seal said open top and bottom ends of said inner tubular member in said fully-closed condition; and complementary tapers on an outside wall of said body above said threads and an inside wall of said cap above said threads, said tapers being drawn into abutment with each other when the straw is in said fully-closed condition to provide a seal between said cap and said body when the straw is in said fully-closed condition.

8. A straw according to claim 7, said closed bottom end of said outer tubular member having a dome-like protrusion extending upwardly therefrom for at least partial insertion into said open bottom end of said inner tubular member, said protrusion and said open bottom end mating to provide a seal against flow of liquid into said open bottom end of said inner tubular member in said fully-closed condition.

9. A straw according to claim 8 further comprising an outward flare on said open bottom end of said inner tubular member, said flare cooperating with a taper on said body during withdrawal of said inner tubular member to prevent further withdrawal of said inner tubular member and cooperating with said dome-like protrusion to provide a seal against flow of liquid into said open bottom end of said inner tubular member in said fully-closed condition.

10. A straw according to claim 9, an outer surface of said body being adapted for liquid-tight connection to a liquid container with said outer tubular member inside the container and an upper portion of said body outside of the container.

11. A straw comprising:

a body having a longitudinal passage therethrough;

an outer tubular member depending from said body, said outer tubular member having a closed bottom end and at least one longitudinal slot through a side wall thereof;

an inner tubular member extending downwardly into said outer tubular member with an annular passage therebetween and extending upwardly through said body passage and engaged thereby to snugly reciprocally slide therein between a fully-closed condition with an open bottom end of said inner tubular member seated on a closed bottom end of said outer tubular member and a fully-opened condition with said open bottom end of said inner tubular member above said closed bottom end of said outer tubular member;

means for plugging said open top end of said inner tubular member;

means for drawing said means for plugging said open top end of said inner tubular member and said closed bottom end of said outer tubular member toward each other to simultaneously seal said open to and bottom ends of said inner tubular member in said fully-closed condition; and means for sealing said means for drawing and said body in said fully-closed condition against flow of liquid therebetween.

12. A straw according to claim 11, said means for drawing comprising a cap mating with said body and covering a portion of said inner tubular member extending upwardly from said body passage.

13. A straw according to claim 12, said means for sealing comprising:

a tapered surface on a thin upper rim of said body; and a complementary tapered surface on an inside wall of said cap, said tapers co-operating to compress said thin rim of said body against said inner tubular member during mating of said cap and said body.

* * * * *